US011452371B1

(12) United States Patent
Li

(10) Patent No.: US 11,452,371 B1
(45) Date of Patent: Sep. 27, 2022

(54) SOFA SHELF

(71) Applicant: SHENZHEN SUPER TOP INNOVATION TECHNOLOGY LIMITED, Shenzhen (CN)

(72) Inventor: Haifeng Li, Shenzhen (CN)

(73) Assignee: SHENZHEN SUPER TOP INNOVATION TECHNOLOGY LIMITED, Shenzhen (CN)

( * ) Notice: Subject to any disclaimer, the term of this patent is extended or adjusted under 35 U.S.C. 154(b) by 0 days.

(21) Appl. No.: 17/357,969

(22) Filed: Jun. 24, 2021

(30) Foreign Application Priority Data

May 11, 2021 (CN) ..... 202121002797.0

(51) Int. Cl.

| | |
|---|---|
| ***A47B 23/02*** | (2006.01) |
| ***A47B 3/08*** | (2006.01) |
| ***A47C 7/70*** | (2006.01) |
| ***A47C 7/68*** | (2006.01) |
| ***A47B 23/00*** | (2006.01) |

(52) U.S. Cl.
CPC ..... *A47B 23/02* (2013.01); *A47B 3/08* (2013.01); *A47B 23/001* (2013.01); *A47C 7/70* (2013.01); *A47C 7/705* (2018.08)

(58) Field of Classification Search
CPC ..... A47B 23/02; A47B 3/08; A47B 23/001; A47C 7/705; A47C 7/70; F16B 23/00; F16B 23/007; F16B 23/0038
USPC ..... 108/115, 25, 49, 42, 126, 130, 43; 411/403
See application file for complete search history.

(56) References Cited

U.S. PATENT DOCUMENTS

| | | | | |
|---|---|---|---|---|
| 160,455 | A * | 3/1875 | Mitchell | |
| 3,168,061 | A * | 2/1965 | Bedol | A47B 3/02 108/116 |
| 3,514,066 | A * | 5/1970 | Henley | A47B 23/02 248/463 |
| 4,311,099 | A * | 1/1982 | Roberts | A47C 7/68 108/43 |
| 8,205,561 | B1 * | 6/2012 | Bierworth | A61G 5/1094 108/157.11 |
| 8,667,904 | B2 * | 3/2014 | Pajic | B60R 11/0252 297/146 |
| 9,501,096 | B2 * | 11/2016 | Sharma | G06F 1/1632 |

(Continued)

FOREIGN PATENT DOCUMENTS

| | | | |
|---|---|---|---|
| CN | 110693190 | * | 1/2020 |
| GB | 2109079 | * | 5/1983 |
| KR | 20110120204 | * | 11/2011 |

*Primary Examiner* — Janet M Wilkens

(57) ABSTRACT

A sofa shelf includes a main body, a support member, a first clamping member, and a second clamping member. The main body is provided with a first surface and a second surface opposite to the first surface. The main body is further provided with a receiving groove located on the first surface. The support member is disposed on the first surface and is movably connected to the main body. The support member is provided with a placing groove arranged obliquely relative to the horizontal plane. Both the first clamping member and the second clamping member are disposed on the second surface. The first clamping member and the second clamping member are rotatably connected to the main body, respectively. Rotation directions of the first clamping member and the second clamping member are opposite.

20 Claims, 4 Drawing Sheets

(56) References Cited

U.S. PATENT DOCUMENTS

| | | | | |
|---|---|---|---|---|
| 2008/0028997 | A1* | 2/2008 | Gramke | A47B 23/001 108/49 |
| 2010/0300334 | A1* | 12/2010 | Tcholakov | A47B 3/08 108/127 |
| 2010/0320349 | A1* | 12/2010 | Necessary | F16M 11/10 248/346.03 |
| 2014/0099173 | A1* | 4/2014 | Zeng | F16B 23/0038 411/427 |
| 2014/0130719 | A1* | 5/2014 | Raml | A47B 5/02 108/42 |
| 2015/0296984 | A1* | 10/2015 | Fan | A47B 97/00 108/42 |
| 2015/0305492 | A1* | 10/2015 | Fountain, Jr. | F16B 2/12 248/231.51 |
| 2016/0286953 | A1* | 10/2016 | Castro | A47B 23/04 |

* cited by examiner

SOFA SHELF

CROSS REFERENCE TO RELATED APPLICATIONS

The present disclosure claims priority to Chinese Patent Application No. 202121002797.0, filed May 11, 2021, which is hereby incorporated by reference herein as if set forth in its entirety.

BACKGROUND

1. Technical Field

The present disclosure relates to the field of furniture, and particularly to a to a sofa shelf.

2. Description of Related Art

People like to eat things while using a mobile phone or a tablet computer when sitting on a sofa, usually, foods are placed in a storage tray, and then the storage tray is placed on a sofa armrest. In particular, when the mobile phone or the tablet computer is used for watching a movie, the mobile phone or the tablet computer can only be held for a long time due to the fact that the storage tray cannot fix the mobile phone or the tablet computer, which can easily cause arm pain. In addition, there is no limiting structure between the storage tray and the sofa armrest, and the storage tray is easily dropped from the sofa armrest.

BRIEF DESCRIPTION OF THE DRAWINGS

In order to more clearly illustrate the technical solutions in this embodiment disclosure, the drawings used in the embodiments or the description of the prior art will be briefly introduced below. It should be understood that, the drawings in the following description are only examples of the present disclosure. For those skilled in the art, other drawings can be obtained based on these drawings without creative works.

DETAILED DESCRIPTION

In order to make the objectives, technical solutions, and advantages of the present disclosure clearer, the present disclosure will be further described in detail below with reference to the drawings and embodiments. It should be understood that, the embodiments described herein are only for explaining the present disclosure and are not intended to limit the present disclosure.

Figure 1:
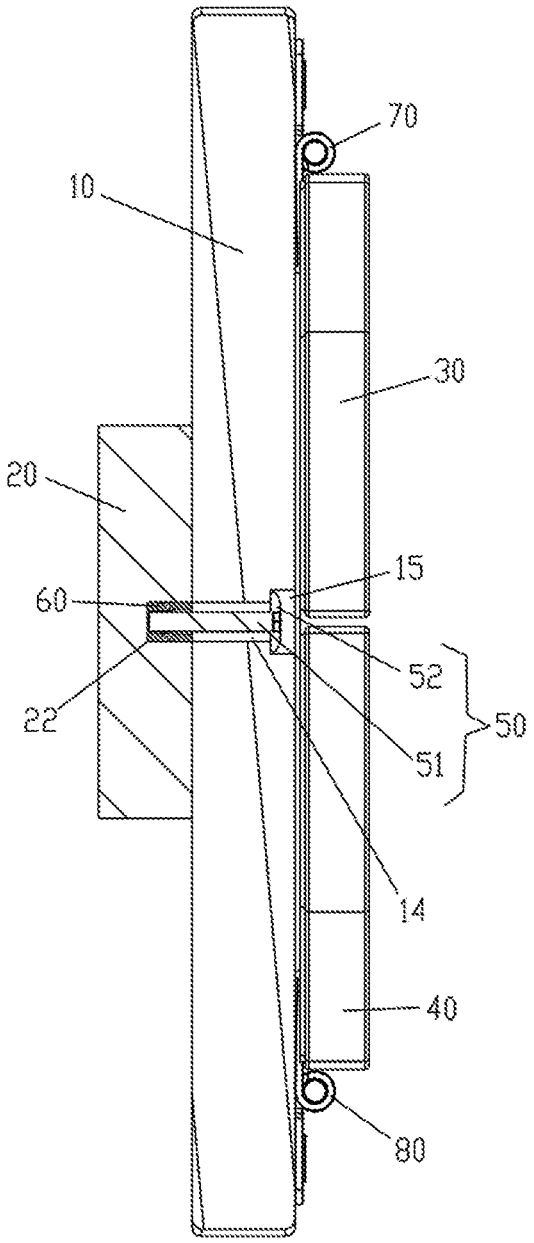
FIG. 1 is a sectional view of a sofa shelf according to the present disclosure.
Figure 2:
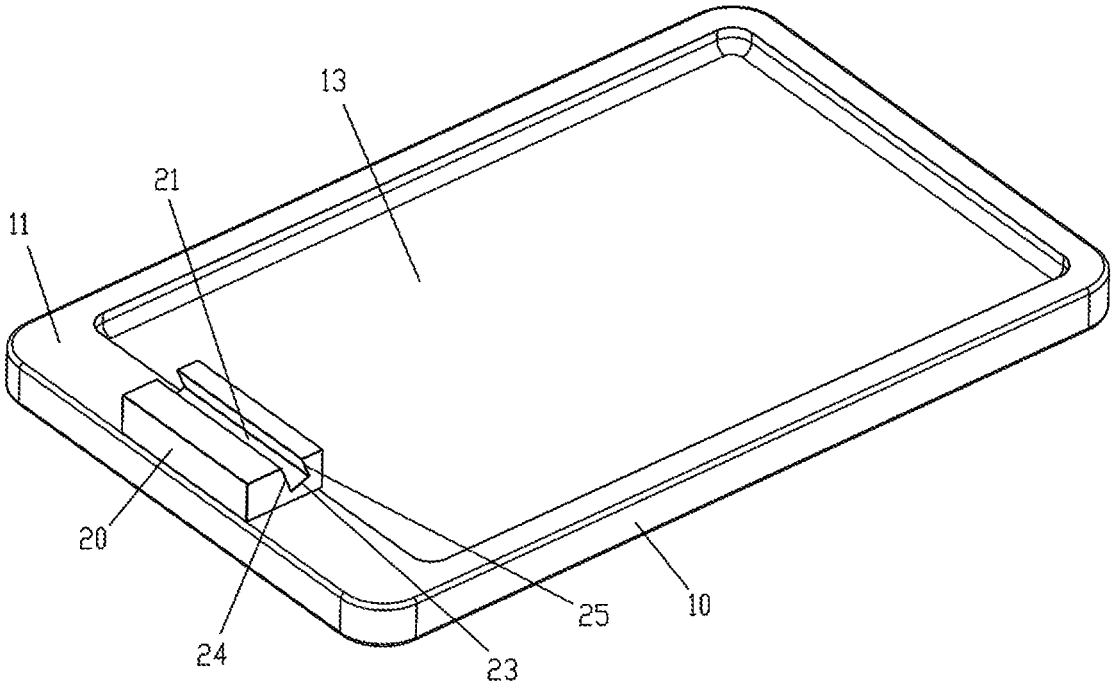
FIG. 2 is a perspective view of the sofa shelf according to the present disclosure.
Figure 3:
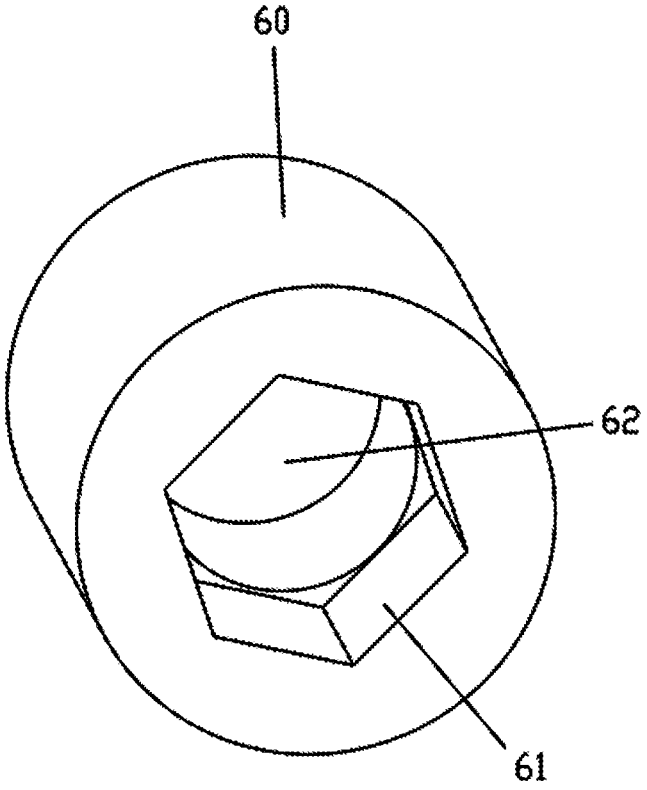
FIG. 3 is a perspective view of a mounting member of the sofa shelf according to the present disclosure.
Figure 4:
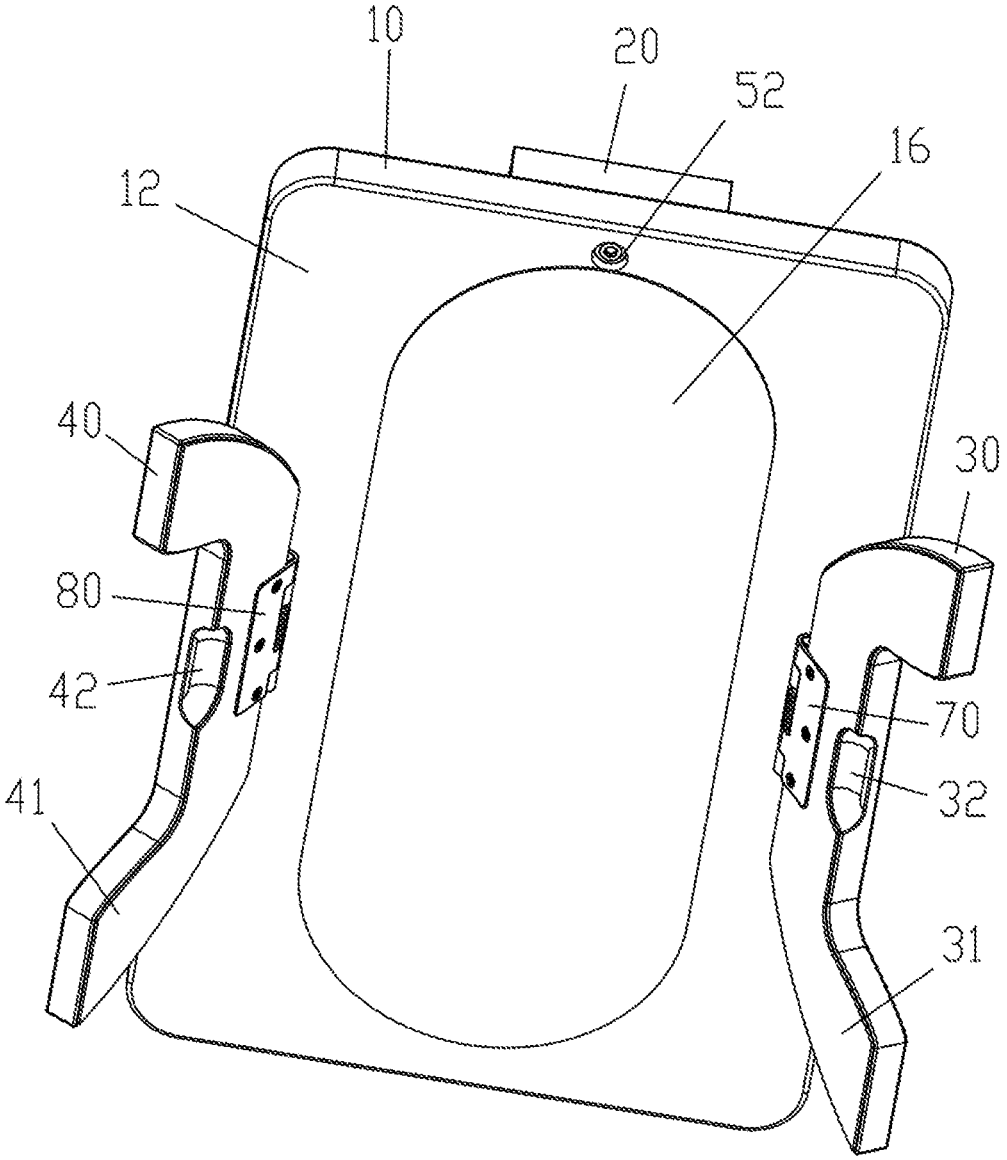
FIG. 4 is a schematic view of an open state of the sofa shelf according to the present disclosure.

Referring to FIGS. 1 to 4, the present disclosure provides a sofa shelf, which includes a main body 10, a support member 20, a first clamping member 30, and a second clamping member 40. The main body 10 is provided with a first surface 11 and a second surface 12 opposite to the first surface 11. The main body 10 is further provided with a receiving groove 13 located on the first surface 11. The support member 20 is disposed on the first surface 11 and is movably connected to the main body 10. The support member 20 is provided with a placing groove 21 arranged obliquely relative to the horizontal plane. Both the first clamping member 30 and the second clamping member 40 are disposed on the second surface 12. The first clamping member 30 and the second clamping member 40 are rotatably connected to the main body 10, respectively, and rotation directions of the first clamping member 30 and the second clamping member 40 are opposite.

In the present embodiment, the support member 20 can rotate relative to the main body 10 by 360 degrees. When a mobile phone or a tablet computer needs to be supported, the mobile phone or the tablet computer is placed in the placing groove 21. By supporting the mobile phone or the tablet computer by the support member 20, the support member 20 can be rotated to adjust the position of the mobile phone or the tablet computer, so that the screen of the mobile phone or the tablet computer is enabled to face a user, which is convenient for the user to watch.

In the present embodiment, in an initial state, both the first clamping member 30 and the second clamping member 40 are attached to the second surface 12, which reduces the space occupied by the sofa shelf and facilitates storage and transportation. When the sofa shelf needs to be clamped on the sofa armrest, the first clamping member 30 and the second clamping member 40 are manually forced to be separated from the second surface 12, the sofa shelf is firmly clamped on the sofa armrest through the first clamping member 30 and the second clamping member 40, and at this case, the second surface 12 is attached to the sofa armrest.

In the present embodiment, the receiving groove 13 is used for placing food.

In addition, the sofa shelf further includes a locking member 50, and the locking member 50 includes a positioning rod 51 and a limiting plate 52. One end of the positioning rod 51 is fixedly connected to the limiting plate 52, and the other end of the positioning rod 51 extends through the main body 10 and is fixedly connected to the support member 20. The limiting plate 52 is abutted against the main body 10.

In the present embodiment, the support member 20 and the main body 10 are movably connected by the locking member 50, and the support member 20 can be rotated by 360 degrees relative to the main body 10.

In addition, the sofa shelf further includes a mounting member 60. The support member 20 is provided with a mounting groove 22. The mounting member 60 is fixedly received in the mounting groove 22. The mounting member 60 is provided with a mounting hole 61 and a positioning hole 62 in communication with the mounting hole 61. The mounting hole 61 is a non-circular hole. An end of the positioning rod 51 away from the limiting plate 52 passes through the mounting hole 61 and extends into the positioning hole 62, and the positioning rod 51 is fixedly connected to the mounting member 60.

In the present embodiment, the mounting member 60 is in threaded connection with an inner wall of the mounting groove 22, so that the mounting member 60 is fixedly received in the mounting groove 22. The mounting hole 61 is a regular hexagonal hole, and the mounting member 60 can be screwed into the mounting groove 22 by a screwdriver matched with the mounting hole 61, so that the mounting is very convenient.

In the present embodiment, the positioning rod 51 is in threaded connection with an inner wall of the positioning hole 62, so that the positioning rod 51 is fixedly connected to the mounting member 60.

In addition, the main body 10 is provided with a through hole 14 and a limiting hole 15 in communication with the through hole 14. The positioning rod 51 extends through the through hole 14, the limiting plate 52 is received in the limiting hole 15, and the limiting plate 52 is abutted against a bottom wall of the limiting hole 15.

In the present embodiment, the limiting plate 52 does not protrude from the main body 10, and the second surface 12 is attached to the sofa armrest when the sofa shelf is clamped on the sofa armrest.

In addition, the support member 20 is provided with a first inclined surface 23, and a second inclined surface 24 and a third inclined surface 25 connected to the first inclined surface 23. The second inclined surface 24 is parallel to the third inclined surface 25. The first inclined surface 23, the second inclined surface 24, and the third inclined surface 25 cooperatively form the placing groove 21. An included angle between the first inclined surface 23 and the horizontal plane is an acute angle, and an included angle between the second inclined surface 24 and the horizontal plane is an obtuse angle.

In the present embodiment, when the mobile phone or the tablet computer is placed in the placing groove 21, the first inclined surface 23 abuts against the bottom of the mobile phone or the tablet computer, the second inclined surface 24 abuts against the rear of the mobile phone or the tablet computer, and the third inclined surface 25 abuts against the front of the mobile phone or the tablet computer. The mobile phone or the tablet computer is placed in the placing groove 21, and since the included angle between the first inclined surface 23 and the horizontal plane is the acute angle, an included angle between the mobile phone or the tablet computer and the main body 10 is an obtuse angle, which is convenient for the user to watch.

In addition, the sofa shelf further includes a first reset hinge 70. One side of the first reset hinge 70 is fixedly connected to the first clamping member 30, and the other side of the first reset hinge 70 is fixedly connected to the main body 10. The first clamping member 30 is attached to the second surface 12 through the first reset hinge 70.

In addition, the sofa shelf further includes a second reset hinge 80. One side of the second reset hinge 80 is fixedly connected to the second clamping member 40, and the other side of the second reset hinge 80 is fixedly connected to the main body 10. The second clamping member 40 is attached to the second surface 12 through the second reset hinge 80.

In the present embodiment, in the initial state, the first clamping member 30 is attached to the second surface 12 by the first reset hinge 70, and the second clamping member 40 is attached to the second surface 12 by the second reset hinge 80.

In the present embodiment, the first clamping member 30 is rotatably connected to the main body 10 through the first reset hinge 70, and the second clamping member 40 is rotatably connected to the main body 10 through the second reset hinge 80. The first clamping member 30 and the second clamping member 40 are symmetrically disposed, so that the rotation directions of the first clamping member 30 and the second clamping member 40 are opposite.

In addition, a first anti-slip layer 31 is fixedly disposed on the first clamping member 30, and a second anti-slip layer 41 is fixedly disposed on the second clamping member 40.

Moreover, a third anti-slip layer 16 is fixedly disposed on the second surface 12.

In the present embodiment, when the sofa shelf is clamped on the sofa armrest by the first clamping member 30 and the second clamping member 40, the first anti-slip layer 31 increases a friction force between the first clamping member 30 and the sofa armrest, the second anti-slip layer 41 increases a friction force between the second clamping member 40 and the sofa armrest, and the third anti-slip layer 16 increases a friction force between the second surface 12 and the sofa armrest, so that the sofa shelf can be firmly clamped on the sofa armrest.

In addition, the first clamping member 30 is further provided with a positioning groove 32, and the second clamping member 40 is further provided with a second positioning groove 42.

In the present embodiment, the first positioning groove 32 facilitates the user to rotate the first clamping member 30, and the second positioning groove 42 facilitates the user to rotate the second clamping member 40.

The sofa shelf according to the present disclosure can be firmly clamped on the sofa armrest by the first clamping member and the second clamping member, and the mobile phone or tablet computer can be placed in the placing groove, and the mobile phone or tablet computer can be supported by the support member.

The above-mentioned embodiments are merely intended for describing but not for limiting the technical schemes of the present disclosure. Although the present disclosure is described in detail with reference to the above-mentioned embodiments, it should be understood by those skilled in the art that, the technical schemes in each of the above-mentioned embodiments may still be modified, or some of the technical features may be equivalently replaced, while these modifications or replacements do not make the essence of the corresponding technical schemes depart from the spirit and scope of the technical schemes of each of the embodiments of the present disclosure, and should be included within the scope of the present disclosure.

What is claimed is:

1. A sofa shelf, comprising:

a main body provided with a first surface and a second surface opposite to the first surface, the main body being further provided with a receiving groove located on the first surface;

a support member disposed on the first surface and movably connected to the main body, the support member being provided with a placing groove arranged obliquely relative to a horizontal plane and provided with a mounting groove;

a first clamping member;

a second clamping member, the first clamping member and the second clamping member being disposed on the second surface and respectively rotatably connected to the main body, and rotation directions of the first clamping member and the second clamping member being opposite;

a locking member, comprising a positioning rod and a limiting plate, one end of the positioning rod being fixedly connected to the limiting plate, and the other end of the positioning rod extending through the main body and being fixedly connected to the support member; and the limiting plate being abutted against the main body; and a mounting member, fixedly received in the mounting groove, the mounting member being provided with a mounting hole and a positioning hole in communication with the mounting hole;

the mounting hole being a non-circular hole, wherein an end of the positioning rod away from the limiting plate passes through the mounting hole and extends into the positioning hole, and the positioning rod is fixedly connected to the mounting member.

2. The sofa shelf of claim 1, wherein the main body is provided with a through hole and a limiting hole in communication with the through hole; the positioning rod extends through the through hole, the limiting plate is received in the limiting hole, and the limiting plate is abutted against a bottom wall of the limiting hole.

3. The sofa shelf of claim 1, wherein the support member is provided with a first inclined surface, and a second inclined surface and a third inclined surface that are connected to the first inclined surface, the second inclined surface is parallel to the third inclined surface; the first inclined surface, the second inclined surface, and the third inclined surface cooperatively form the placing groove; an included angle between the first inclined surface and the horizontal plane is an acute angle, and an included angle between the second inclined surface and the horizontal plane is an obtuse angle.

4. The sofa shelf of claim 1, further comprising a first reset hinge, one side of the first reset hinge being fixedly connected to the first clamping member, and the other side of the first reset hinge being fixedly connected to the main body; the first clamping member being attached to the second surface through the first reset hinge.

5. The sofa shelf of claim 1, further comprising a second reset hinge, one side of the second reset hinge being fixedly connected to the second clamping member, and the other side of the second reset hinge being fixedly connected to the main body; the second clamping member being attached to the second surface through the second reset hinge.

6. The sofa shelf of claim 1, wherein a first anti-slip layer is fixedly disposed on the first clamping member, and a second anti-slip layer is fixedly disposed on the second clamping member.

7. The sofa shelf of claim 1, wherein a third anti-slip layer is fixedly disposed on the second surface.

8. The sofa shelf of claim 1, wherein the first clamping member is further provided with a positioning groove, and the second clamping member is further provided with a second positioning groove.

9. The sofa shelf of claim 1, wherein the sofa shelf has a first state in which both the first clamping member and the second clamping member are attached to the second surface and a second state in which the first clamping member and the second clamping member are away from the second surface and the second surface is configured to be attached to a sofa armrest.

10. The sofa shelf of claim 1, wherein the mounting member is in threaded connection with an inner wall of the mounting groove.

11. A sofa shelf, comprising:

a main body provided with a first surface and a second surface opposite to the first surface, the main body being further provided with a receiving groove located on the first surface;

a support member disposed on the first surface and movably connected to the main body, the support member being provided with a first inclined surface, a second inclined surface, and a third inclined surface, both the second inclined surface and the third inclined surface being connected to the first inclined surface and parallel to each other; the first inclined surface, the second inclined surface, and the third inclined surface cooperatively define a placing groove; an included angle between the first inclined surface and a horizontal plane is an acute angle, and an included angle between the second inclined surface and the horizontal plane is an obtuse angle; the support member being further provided with a mounting groove;

a mounting member fixedly received in the mounting groove, the mounting member being provided with a non-circular mounting hole and a positioning hole in communication with the mounting hole; wherein a positioning rod is inserted into the positioning hole through the mounting hole to fixedly connect the positioning rod to the mounting member; and a first clamping member and a second clamping member, disposed on the second surface and respectively rotatably connected to the main body, and rotation directions of the first clamping member and the second clamping member being opposite.

12. The sofa shelf of claim 11, further comprising a limiting plate, one end of the positioning rod being fixedly connected to the limiting plate, and the other end of the positioning rod extending through the main body and being fixedly connected to the support member; and the limiting plate being abutted against the main body.

13. The sofa shelf of claim 12, wherein the main body is provided with a through hole and a limiting hole in communication with the through hole; the positioning rod extends through the through hole, the limiting plate is received in the limiting hole, and the limiting plate is abutted against a bottom wall of the limiting hole.

14. The sofa shelf of claim 11, further comprising a first reset hinge, one side of the first reset hinge being fixedly connected to the first clamping member, and the other side of the first reset hinge being fixedly connected to the main body; the first clamping member being attached to the second surface through the first reset hinge.

15. The sofa shelf of claim 11, further comprising a second reset hinge, one side of the second reset hinge being fixedly connected to the second clamping member, and the other side of the second reset hinge being fixedly connected to the main body; the second clamping member being attached to the second surface through the second reset hinge.

16. The sofa shelf of claim 11, wherein a first anti-slip layer is fixedly disposed on the first clamping member, and a second anti-slip layer is fixedly disposed on the second clamping member.

17. The sofa shelf of claim 11, wherein a third anti-slip layer is fixedly disposed on the second surface.

18. The sofa shelf of claim 11, wherein the first clamping member is further provided with a positioning groove, and the second clamping member is further provided with a second positioning groove.

19. The sofa shelf of claim 11, wherein the sofa shelf has a first state in which both the first clamping member and the second clamping member are attached to the second surface and a second state in which the first clamping member and the second clamping member are away from the second surface and the second surface is configured to be attached to a sofa armrest.

20. The sofa shelf of claim 11, wherein the mounting member is in threaded connection with an inner wall of the mounting groove.

* * * * *